US006071097A

United States Patent [19]

Gruett et al.

[11] Patent Number: 6,071,097

[45] **Date of Patent: *Jun. 6, 2000**

[54] SINGLE-PIECE PISTON FOR USE IN A PNEUMATICALLY-ACTIVATED PUMP

[75] Inventors: Donald G. Gruett, Manitowoc; Scott Wright, Pewaukee; Michael Wech, Manitowoc, all of Wis.

[73] Assignee: Oil-Rite Corporation, Manitowoc, Wis.

[ * ] Notice: This patent is subject to a terminal disclaimer.

[21] Appl. No.: 08/920,913

[22] Filed: Aug. 29, 1997

[51] Int. Cl.[7] ..... F04B 39/10; F04B 53/12

[52] U.S. Cl. ..... 417/553; 417/570; 184/55.2

[58] Field of Search ..... 417/553, 570, 417/401; 92/172, 159, 158; 184/55.2, 55.1, 39.1, 74

[56] References Cited

U.S. PATENT DOCUMENTS

| | | | |
|---|---|---|---|
| 454,613 | 6/1891 | Downie et al. . | |
| 1,442,488 | 1/1923 | MacGregor . | |
| 3,485,180 | 12/1969 | Wickenberg et al. . | |
| 3,544,239 | 12/1970 | Graham . | |
| 3,731,763 | 5/1973 | Thrasher, Jr. et al. . | |
| 3,982,471 | 9/1976 | Finger | 417/511 |
| 4,096,924 | 6/1978 | Lyden . | |
| 4,125,176 | 11/1978 | Thrasher, Jr. . | |
| 4,157,132 | 6/1979 | Kramer | 184/7 D |
| 4,450,938 | 5/1984 | Davenport et al. . | |
| 4,784,578 | 11/1988 | Gruett . | |
| 4,784,584 | 11/1988 | Gruett . | |
| 4,975,028 | 12/1990 | Schultz | 417/442 |
| 5,002,156 | 3/1991 | Gaunt . | |
| 5,253,984 | 10/1993 | Gruett et al. . | |
| 5,299,917 | 4/1994 | Schultz . | |
| 5,338,166 | 8/1994 | Schultz . | |
| 5,443,370 | 8/1995 | Wang . | |
| 5,449,278 | 9/1995 | Lin | 417/526 |
| 5,638,920 | 6/1997 | Gruett . | |
| 5,669,532 | 9/1997 | Dorrow et al. | 220/401 |

*Primary Examiner*—Charles G. Freay
*Assistant Examiner*—David J. Torrente
*Attorney, Agent, or Firm*—Godfrey & Kahn, S.C.

[57] ABSTRACT

A single-piece piston for use in a pneumatically-activated pump to meter a predetermined amount of lubricant or other liquid. The piston has a grooved end that includes a head portion and a circumferentially-disposed angled channel for containing a sealing member such as an O-ring. An adjacent stem section includes a longitudinally-disposed channel that is in fluid-flow connection with the angled channel. The piston is disposed within a chamber of the body of the pump. Lateral movement of the piston within the body causes the sealing member to shift and block and unblock the end of the longitudinal channel which allows liquid from a liquid chamber to flow into a slot and to a pump chamber adjacent to the head of the piston's grooved end. The piston operates in association with an assembly for regulating the amount of liquid metered by the pump, a valve assembly for evacuating the liquid from the pump chamber into and through an outlet fitting, and a mechanism for regulating the flow of air into the outlet fitting to atomize the liquid.

15 Claims, 8 Drawing Sheets

10
34
38
49
36
69
132
74
76
"D"
73
130
11
133
134
138
139

SINGLE-PIECE PISTON FOR USE IN A PNEUMATICALLY-ACTIVATED PUMP

FIELD OF THE INVENTION

The present invention relates to devices that are used to precisely meter a liquid. More particularly, the invention relates to a piston or injector used in a pneumatically-activated lubricator or other pump that can meter a precise volume of fluid such as a lubricant.

BACKGROUND OF THE INVENTION

Pneumatically-activated pumps are known and used for metering a desired amount of a lubricant or other fluid from a source to a tool or machine. One type of pneumatically-activated pump is an air tool lubricator that is used to deliver precise amounts of a lubricant, typically an oil, to an air tool. The air tool lubricator is coupled to an air line upstream from the air tool and senses air flow when the tool is cycled, whereupon the lubricator injects a precise volume of lubricant into the airline. The air stream in the air line then carries the lubricant to the air tool. An example of an air tool lubricator is found in U.S. Pat. No. 4,450,938 (Davenport) which has a single ball check design that deposits oil directly into the air line.

In other lubricators, such as the Servo Meters™ lubricator (Master Pneumatic—Detroit, Inc.), air pressure on a piston pushes a metering pin into a bored hole a preset distance which forces the lubricant through a check valve and into a lubricant line. A ball check valve is used at the air tool so that the lubricant line remains filled with lubricant. A drawback of these lubricators is a tendency to entrap air within the device which reduces their precision.

Other pumps, such as the lubricator shown in U.S. Pat. No. 4,784,584 (Gruett), are made with a two-piece piston arrangement composed of a metering piston and an actuating piston that moves in response to air pulses. The dual-piston construction prevents air from being entrapped within the device, providing more accurate metering of liquid to the air tool. However, the two-piece design is relatively complex, and increases the time and precision required to manufacture a lubricator.

Accordingly, it would be desirable to have a pneumatically-activated pump with a relatively simple design, and which is capable of preventing air from being entrapped inside it. It would also be desirable to have a piston for use in a pneumatically-activated lubricator or other pump that is constructed from relatively few components, and is capable of reducing or preventing air entrapment in the pump.

SUMMARY OF THE INVENTION

Therefore, it is an object of the present invention to provide a pneumatically-activated lubricator that has a relatively simple design for metering an amount of lubricant or other liquid to an air tool. Another object is to provide a single-piece piston for use in a pneumatically-activated lubricator that is designed to reduce or prevent air entrapment in the lubricator. Yet another object is to provide a single-piece piston having a channel and slot that allows lubricant to flow through the piston in a controlled manner.

These and other objects and advantages are achieved in a pneumatically-activated lubricator (which is more broadly described as a pump) having a piston disposed within a chamber. The piston is a single-piece construction and operates in conjunction with air and liquid adjustment assemblies and an evacuation valve assembly to meter a precise amount of lubricant.

The single-piece piston has a first grooved end section with a flat head, a channel that is circumferentially disposed about the piston, and a slot that extends from the head to the channel. The channel is angled and has a movably seated sealing member, such as an O-ring therein. The angled channel is roughly U-shaped with one side being deeper than the other.

The piston also has a stem section that is adjacent to the grooved end. The stem section has a slot that extends longitudinally along the exterior of the stem and forms a conduit for the flow of liquid into the angled channel. When the piston is disposed within the body of a lubricator, lateral motion of the slidable piston causes the sealing member in the angled channel to move between a first position adjacent one side of the channel and a second position adjacent the other side of the channel. With the sealing member in the first position, the end of the conduit is uncovered, and liquid from a liquid chamber surrounding the stem of the piston is allowed to flow into the conduit, into the angled channel, and through the slot to a metering or pump chamber adjacent to the head of the piston. When in a second position in the angled channel, the sealing member blocks the end of the conduit to prevent liquid from flowing from the conduit into the angled channel and to the slot.

The piston operates in conjunction with an assembly (liquid adjustment stem) that regulates its stroke, a valve assembly for assisting the evacuation of liquid from the pump chamber into a central bore in an outlet fitting, and a mechanism that regulates the flow of an air source into the bore of the outlet member to atomize the liquid flowing therethrough. The piston and most other components are disposed in chambers within the body and the body includes openings for receiving tubing for conducting compressed air and liquid into the appropriate chambers in the apparatus.

One end of the liquid adjustment stem is positioned against the piston and the other end extends out an opening in the body so that the user can adjust and regulate the amount of liquid metered by the lubricator. The evacuation valve assembly is disposed within a liquid evacuation chamber. One end of the evacuation valve assembly is coupled to the outlet fitting. The other end of the evacuation valve assembly includes a valve that is removably seated against the outlet of the pump chamber.

An output air flow adjustor is disposed through another opening in the body with one end controlling the flow of air into the outlet fitting. The air introduced into the outlet fitting atomizes the liquid therein. The other end of the air adjustor stem assembly extends out of the body so that the user can regulate the flow of air into the central bore of the outlet fitting. The end of the outlet fitting that projects from the body is adapted to be coupled to a tube to carry the liquid to an air tool or other device or object.

The lubricant is discharged in a predetermined amount by the action of the piston. The stroke of the piston determines the amount of liquid metered and the stroke is controlled by the liquid adjustment stem. Advantageously, the present invention provides a lubricator that incorporates a single piston to meter the liquid that effectively prevents entrapment of air within the lubricator and achieves this goal with a relatively simple design that eliminates the need for a dual-piston set-up as used in other lubricators. The present piston also allows precision metering of very small volumes of liquid (e.g., less than 1/2500th ml per cycle) at a wide range of cycle rates (e.g., 20 cycles per second to one cycle per day) and can be readily calibrated for preset output volumes. Another advantage of the piston is that it may be used with a variety of petroleum and synthetic lubricants and even water and other liquids depending on the application at hand.

BRIEF DESCRIPTION OF THE DRAWINGS

Throughout the following views, reference numerals will be used on the drawings, and the same reference numerals will be used throughout the several views and in the description to indicate same or like parts of the invention.

DETAILED DESCRIPTION

Figure 1:
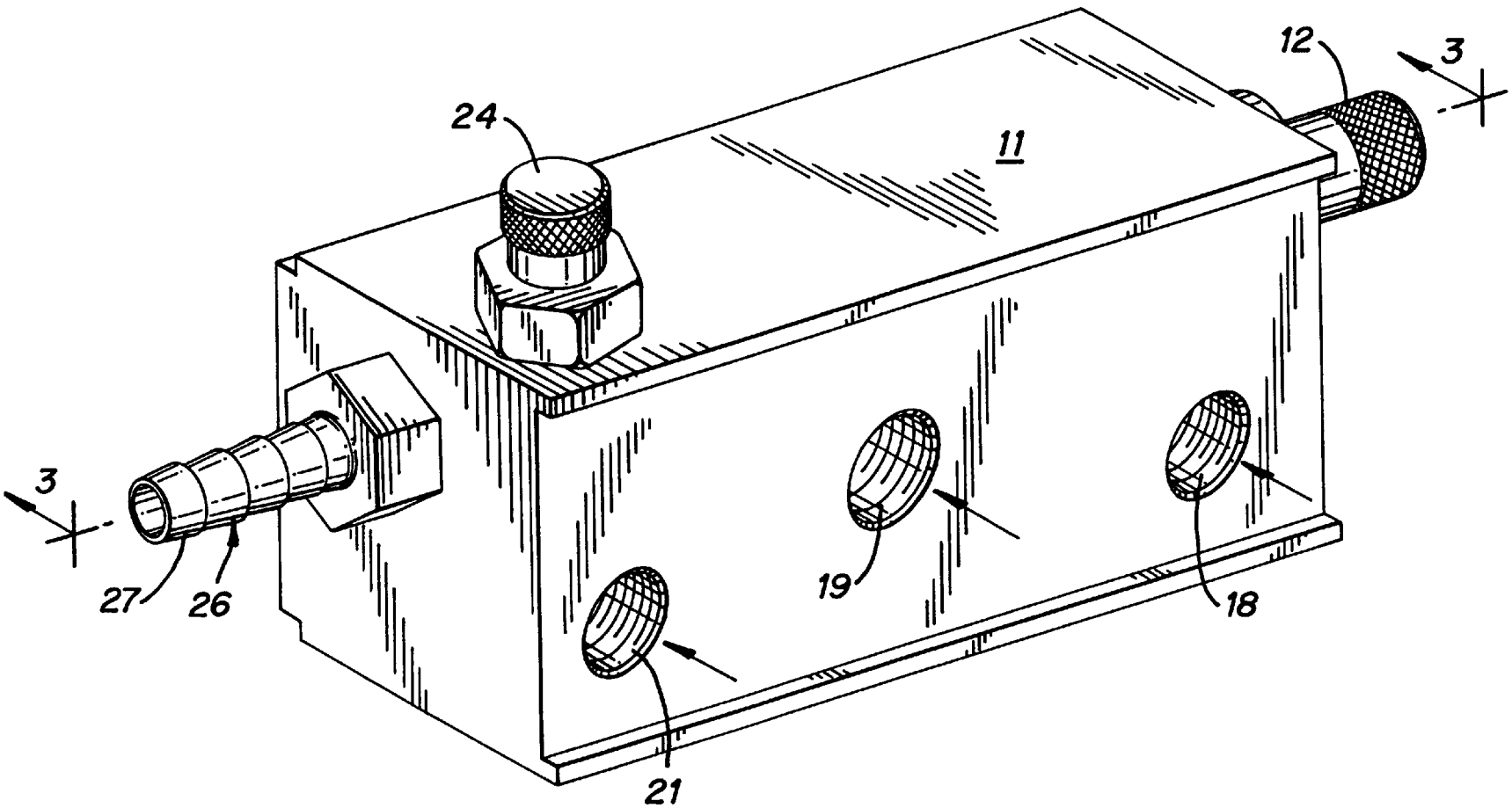
FIG. 1 is a perspective view of a pneumatically-activated lubricator constructed according to the present invention.

Referring now to the drawings, an embodiment of a pneumatically-activated lubricator 10, incorporating the single-piece piston 38 of the invention is shown in FIG. 1. It is understood that the piston 38 can be incorporated into a variety of lubricators and, more generally, pumps that are pneumatically-activated to deliver a liquid to a desired location in a controlled manner. However, for purposes of explanation, the operation of the piston in one specific lubricator is described herein.

Figure 2:
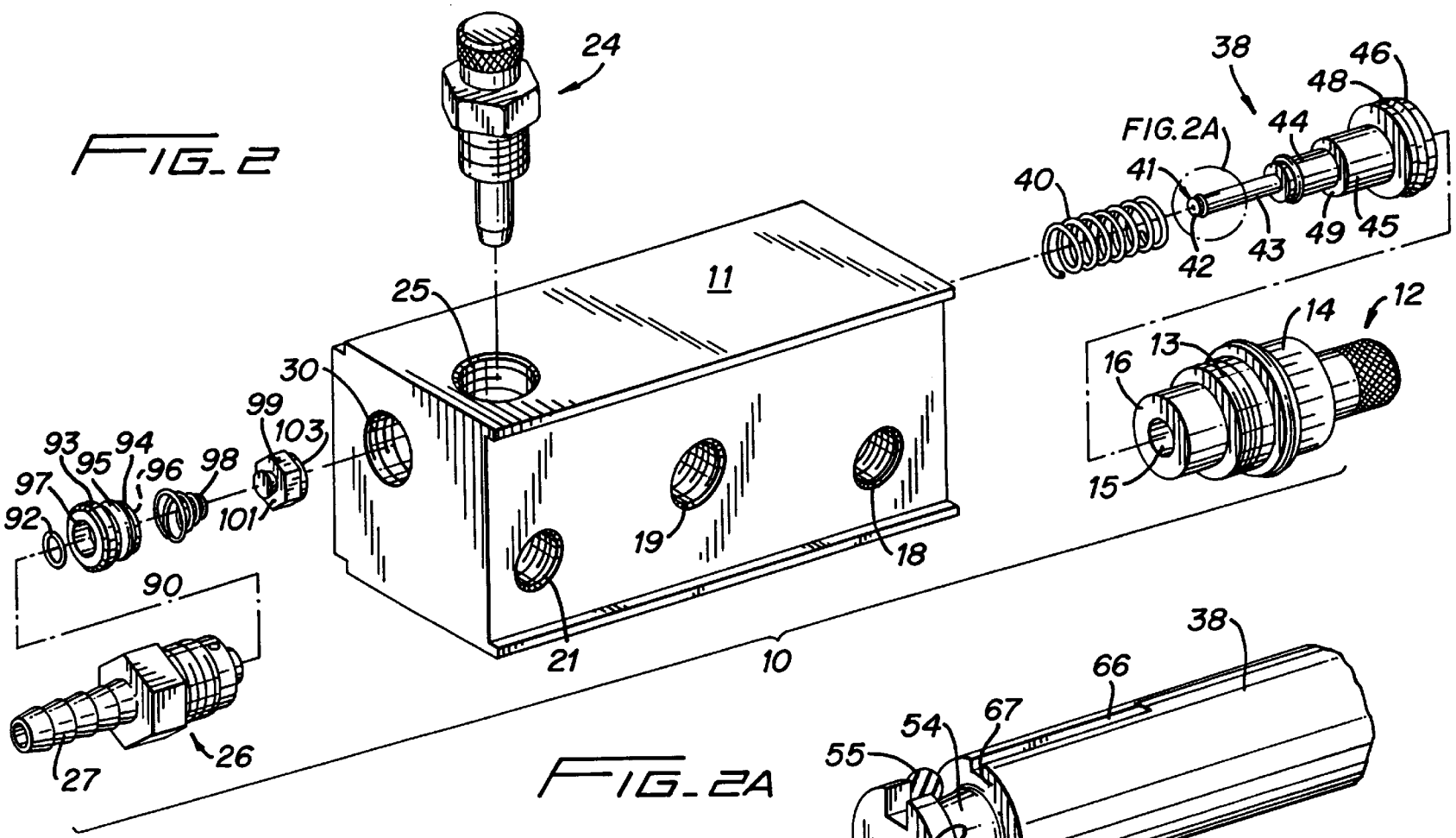
FIG. 2 is a perspective, exploded view of the lubricator of FIG. 1.

As depicted in FIG. 1, the lubricator 10 includes a main body 11 and a liquid adjustment stem 12. As can be seen in FIG. 2, the liquid adjustment stem 12 has a threaded portion 13, a graduated portion 14, a central bore 15, and a stop end 16. The body 11 also includes a first air inlet bore 18 and a liquid inlet bore 19. The lubricator 10 includes a second air inlet bore 21, and an assembly 24 for adjusting the output air flow ("output air flow adjustor") for atomizing the liquid. The assembly 24 is removably inserted into a bore 25. A barbed, outlet fitting 26 having an outlet end 27 is mounted on one end of the body 11.

Figure 3:
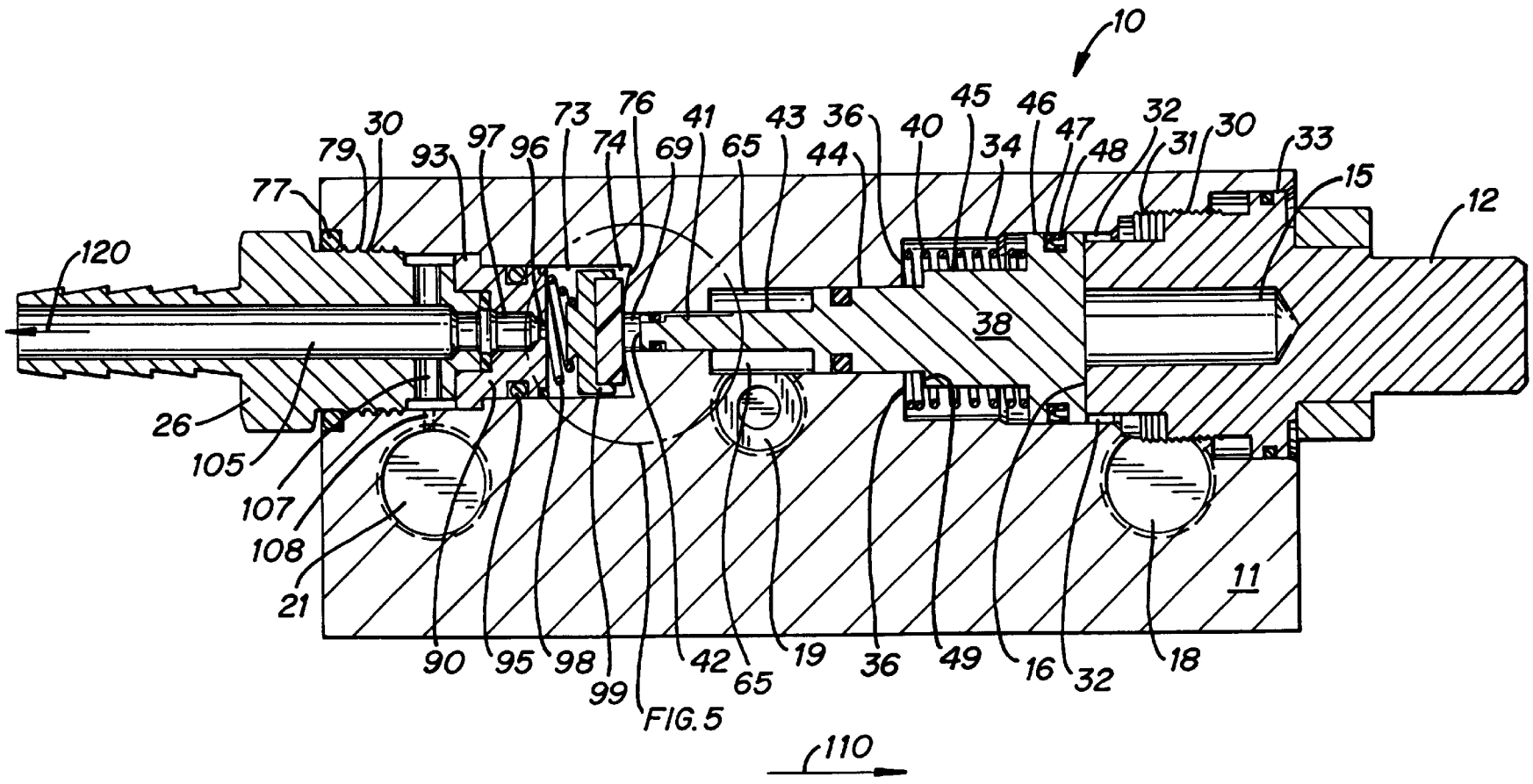
FIG. 3 is a cross-sectional view of the lubricator of FIG. 1 taken along line 3—3 and showing the piston in a first position in the lubricator.
Figures 4, 6:
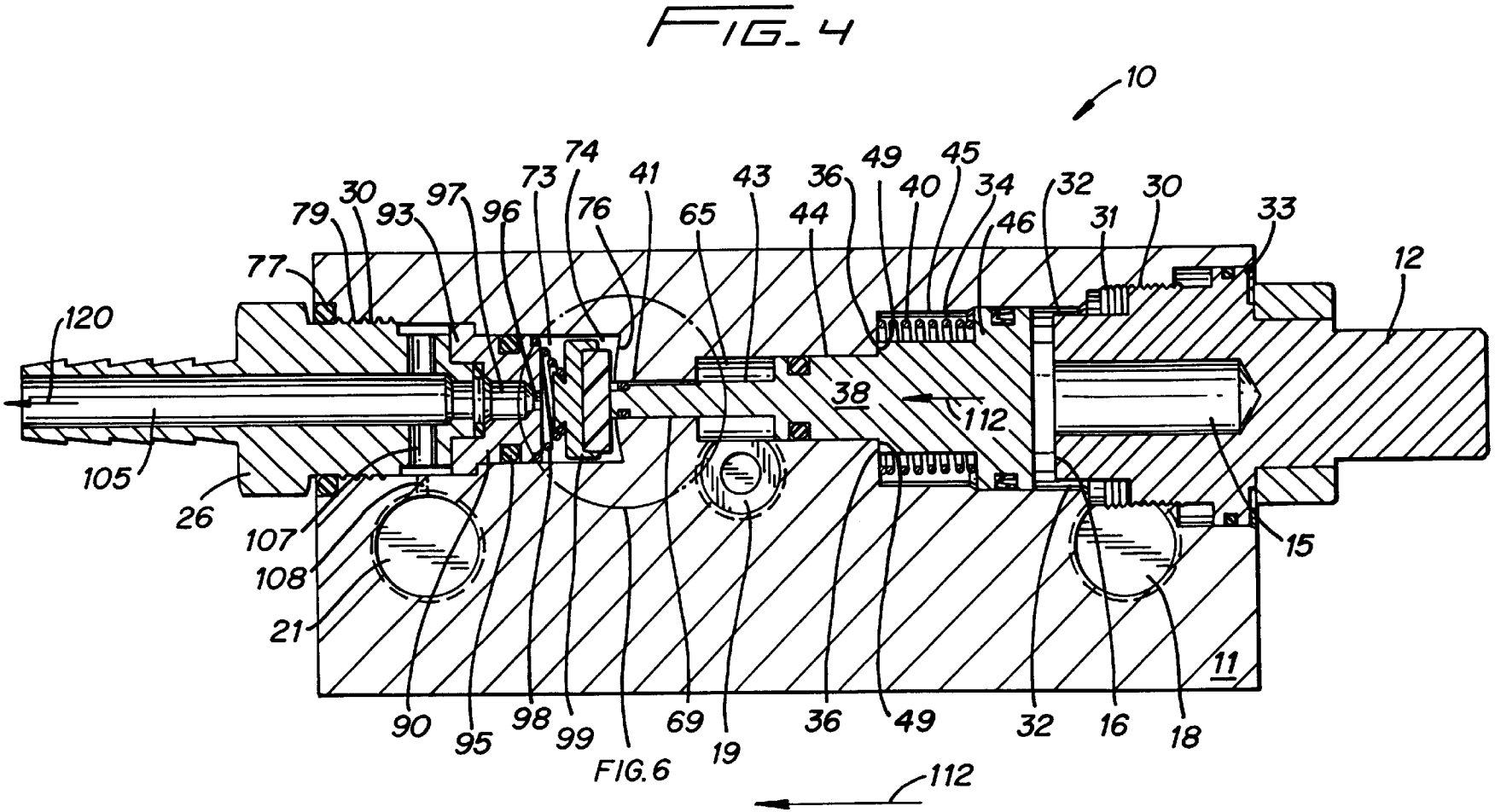
FIG. 4 is a cross-sectional view as in FIG. 3, showing the single-piece piston in a second position in the lubricator.
FIG. 6 is an enlarged cross-sectional view of a portion of the piston of FIG. 4.

As best seen by reference to FIGS. 2, 3, and 4, a central bore 30 extends the entire length of the body 11 and defines a plurality of chambers. As shown in FIGS. 3 and 4, the body 11 includes an air inlet chamber 31. The inlet chamber 31 has an opening 33 and a threaded sidewall that is adapted to receive the liquid adjustment stem 12. The stop end 16 of the liquid adjustment stem 12 and the inlet chamber 31 are sized such that there is a gap 32 between the stop end 16 and the inlet chamber 31. In addition, the inlet chamber 31 is in fluid communication with the first air inlet bore 18. Adjacent to the inlet chamber 31 is a piston chamber 34 that is adapted to receive the piston 38.

The piston 38 has a first grooved end section 41 with a head portion 42, a stem section 43, a first intermediate section 44, a second intermediate section 45, and a second disc-shaped end section 46. The second disc-shaped end section 46 has a groove 47 and a sealing member 48 seated therein. Preferably, the piston 38 is made from a single piece of hard and durable material such as steel, stainless steel, plated steel, brass, and the like.

The piston 38 is biased in a first position within the piston chamber 34 by a spring 40. The piston 38 has a stepped design such that the diameter of the disc-shaped end 46 is greater than the diameter of the second intermediate section 45 which is, in turn, greater than the diameter of the first intermediate portion 44. The piston 38 is stepped to provide an annular shoulder 49 that engages the vertical wall or stop 36 of the piston chamber 34 to terminate the working stroke or forward movement of the piston 38.

Figure 2A:
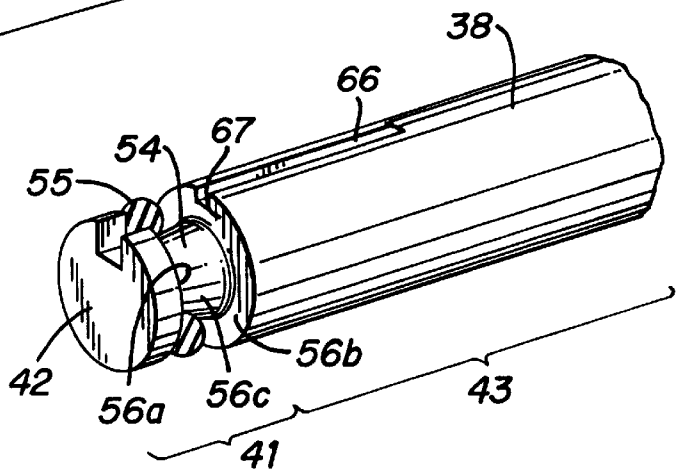
FIG. 2A is an enlarged perspective view of a portion of the piston of FIG. 2.

The first grooved end section 41 of the piston 38 includes an angled channel 54 (FIG. 2A) in which a sealing member 55, such as an O-ring, sits. As best seen by reference to FIGS. 5 and 6, the angled channel 54 is roughly U-shaped, with a first side 56*a*, a second side 56*b*, and a bottom or base portion 56*c* therebetween that is slanted or oriented at an angle from the first side 56*a* to the second side 56*b* such that the channel 54 is deepest adjacent the first side 56*a*. The grooved end section 41 also includes a slot 57 that extends from the channel 54 to the head 42 for transferring liquid from the channel 54 into a metering or pump chamber (discussed below) adjacent to the head 42.

A part of the first intermediate section 45 and the stem section 43 of the piston 38 are positioned in a liquid chamber 65 (FIG. 3). The stem section of the piston 38 includes a longitudinal slot or conduit 66 having an end 67 for transferring liquid from the liquid chamber 65 into the second, angled channel 54. The liquid chamber 65 is in fluid communication through a passageway (not shown) with the liquid inlet bore 19.

Figure 5:
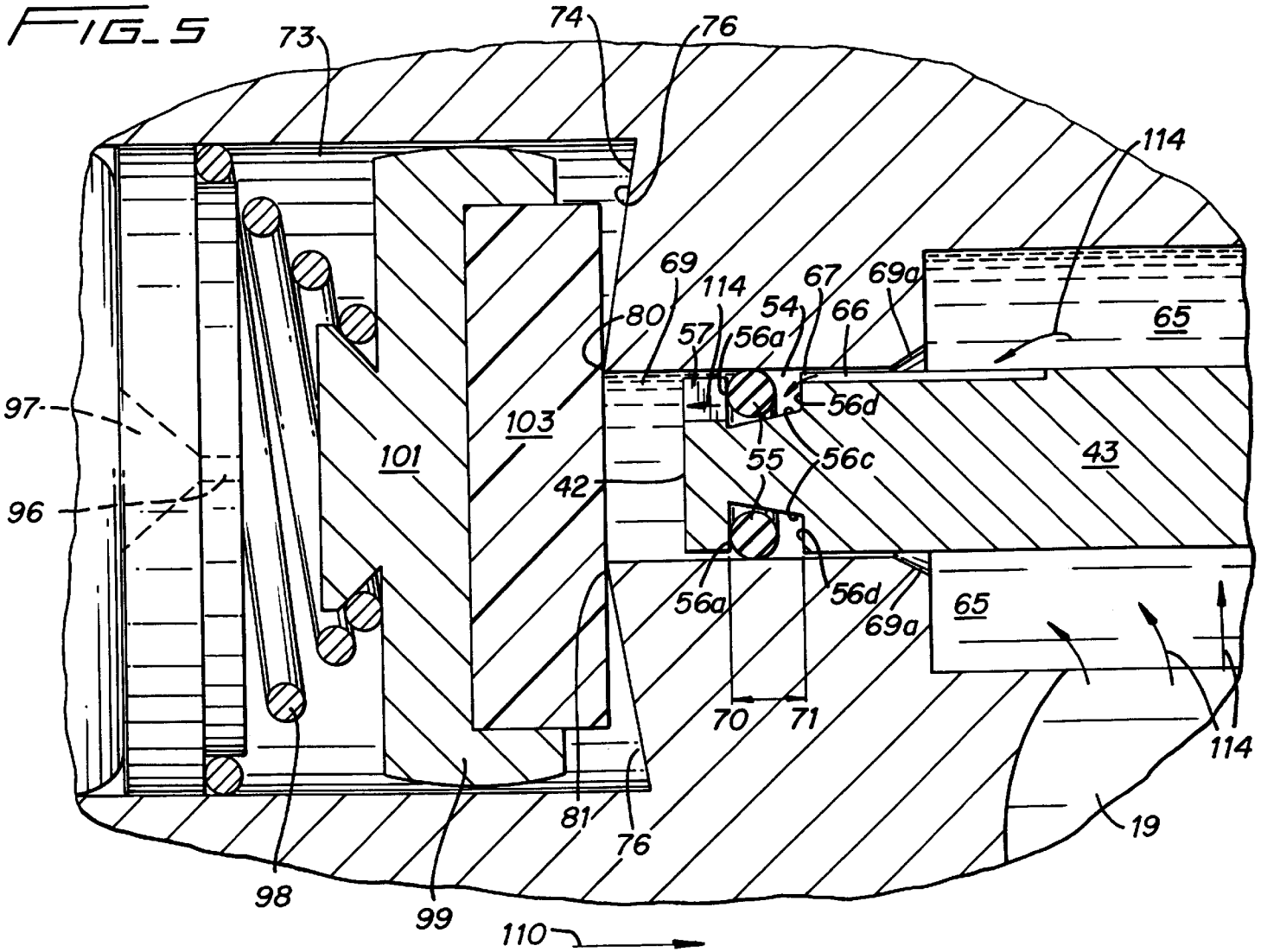
FIG. 5 is an enlarged cross-sectional view of a portion of the piston of FIG. 3.
Figure 6:
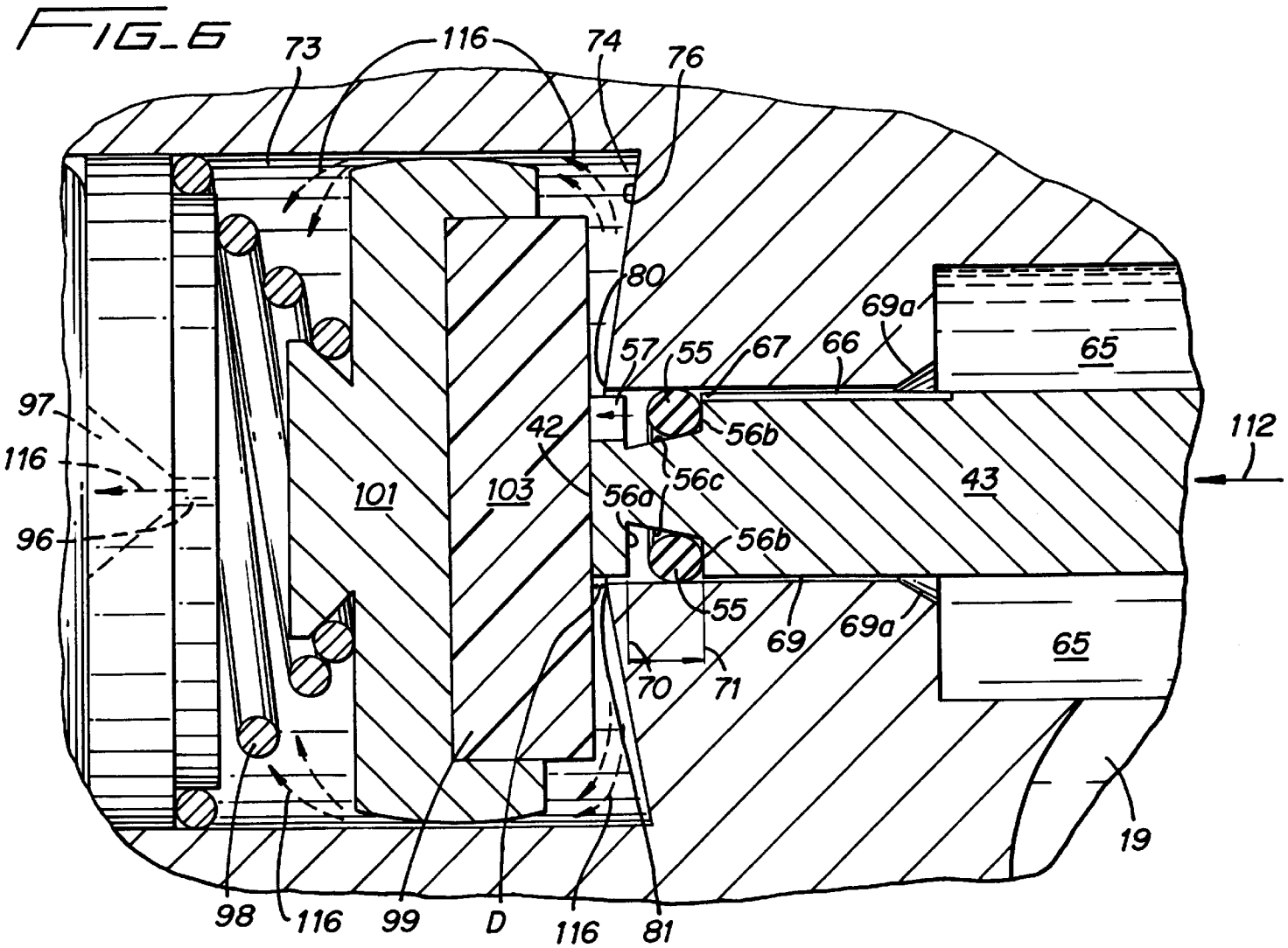

As best seen by reference to FIGS. 5 and 6, the first grooved end 41 of the piston 38 is positioned within a pump chamber 69 that may have a flaring 69*a*. The sealing member 55 and the angled channel 54 of the piston 38 are sized to allow the sealing member 55 to move between a first position 70 and a second position 71 in the angled channel 54 when the piston 38 moves laterally within the pump chamber 69. To allow the sealing member 55 to freely shift back and forth in the angled channel 54 and seal properly, it is preferred that the base portion 56*c* has an angle of about 10–20° with respect to the centerline of the lubricator, preferably about 15°. As shown in FIG. 5, the sealing member 55 is in the first position 70 in the channel 54 (adjacent to first side 56*a*) during the return stroke and when the piston 38 is at the top of a cycle, wherein the end 67 of the conduit 66 are uncovered. This allows fluid to flow from the conduit 66 into the angled channel 54 and through the slot 57 to the pump chamber 69. The flaring 69*a* helps direct liquid toward the pump chamber 69.

As seen in FIG. 6, the sealing member 55 is in the second position 71 in the channel 54 (adjacent to second side 56*b*) on the "down stroke" and when the piston 38 is at the end or bottom of a cycle, wherein the end 67 of the conduit 66 is blocked by the sealing member 55 such that fluid does not flow into the angled channel 54 nor to the slot 57.

Adjacent to the pump chamber 69 is a liquid evacuation chamber 73. The evacuation chamber 73 has a first end 74 with a curved and preferably linearly angled wall 76 and a second end 77 (FIGS. 3 and 4) with a threaded portion 79 for receiving the outlet fitting 26. The curved wall 76 has two contact points 80 and 81. Positioned between the outlet fitting 26 and the curved wall 76 is an evacuation valve assembly 90. The evacuation valve assembly includes an O-ring 92, a valve collar or sleeve 93 having a groove 94 in which an O-ring or like sealing member 95 is seated, an aperture 96 that faces the pump chamber 69, and a longitudinal bore 97. The evacuation assembly also includes a biasing means, such as a spring 98, and a evacuation valve 99. The evacuation valve 99 has a valve nut, such as hexagonally-shaped nut 101, and a plug seal 103. The plug seal 103 is biased against the relatively sharp and defined contact points 80 and 81 to provide a tight seal between the pump and evacuation chambers 69 and 73, respectively.

As noted, the output air flow adjustor 24 is inserted into the bore 25 in the main body 11. A bore 105 in the outlet fitting 26 is coupled in fluid communication to the longitudinal bore 97. An air passageway 107 that is coupled in fluid communication via a passageway 108 to the second air inlet bore 21 allows air to flow into the bore 105. The output air flow adjuster 24 controls the amount of air that flows through the passageway 108 from the second air inlet bore 21, and ultimately the amount of air that flows through the bore 105 to atomize the liquid passing therethrough.

In a preferred embodiment, wherein the sealing member 55 is an O-ring, the angle of the base portion 56*c* of the angled channel 54 is about 15°±5°, the diameter of the angled channel 54 adjacent to the first side 56*a* is about 60–80% of the inside diameter (i.d.) of the O-ring, preferably about 70%, and the diameter of the angled channel 54 adjacent to the second side 56*b* is about 105–125% of the inside diameter of the O-ring, preferably about 115%. It is also preferred that the depth of the conduit 66 is less than about 33% of the thickness of the O-ring in order to prevent liquid loss during the down stroke in the direction of arrow 112 (FIG. 6). It is further preferred that the depth of the slot 57 is about 100%±7% of the O-ring cross-section diameter to allow liquid to fill the pump chamber 69 on the return stroke of this piston 38 in the direction of arrow 110 (FIG. 5). It is also desirable that the cross-sectional area of slot 57 is equal to or greater than the cross-sectional area of the conduit 66 in order to prevent a fluid restriction to the flow of fluid from the chamber 65 to the pump 69.

It should be understood that various means beyond the springs and O-rings shown can be used for the purposes of providing the proper biasing and sealing for the components of the present invention.

Operation

When properly connected to a source of compressed air, the pneumatically-activated lubricator 10 incorporating the piston 38 of the present invention delivers a precise amount of lubricant or other liquid to the air tool. Preferably and advantageously, the lubricator 10 is designed with a unique evacuation valve assembly 90 and evacuation chamber 73 that prevent air bubbles from being entrapped within the device, which design is based upon an earlier lubricator disclosed in U.S. Pat. No. 4,784,584, the disclosure of which is incorporated by reference herein.

The piston 38 operates in a cycle to feed liquid from the liquid chamber 65 into the metering or pump chamber 69 (FIGS. 3 and 5), and to dispense and pump the liquid past the evacuation valve 99, and into the central bores 97, 105 of the sleeve 93 of the evacuation valve assembly 90 and the outlet fitting 26, respectively.

A tube (not shown) couples the liquid inlet bore 19 to a source of liquid, usually a lubricant material. Liquid flows from the tube through the passageway (not shown) into the liquid chamber 65 and into the conduit 66 in the piston 38. Depending on the position of the piston 38, liquid will also flow into the pump chamber 69. The type of liquid or lubricant used depends on the application at hand. However, the present invention is capable of metering various synthetic and petroleum based lubricants and even water. Tubing (also not shown) is connected to the air inlet bore 18 and inlet bore 21 to deliver compressed air from an air source into the inlet chamber 31 and the outlet fitting 26. Air that enters the inlet chamber causes the piston 38 to move. Air that is delivered into the outlet fitting 26 atomizes the liquid received from the evacuation chamber 73.

Before the lubricator 10 is operated, the liquid chamber 65 and the pump chamber 69 are filled with air. As seen in FIGS. 3 and 5, the evacuation valve 99 is biased against the contact points 80 and 81 and seals the pump chamber 69 closed. As the piston 38 is drawn away from the pump chamber 69 (moves to the right) in the direction of arrow 110, a deferential pressure is created causing the sealing member 55 in the piston 38 to move to the first side 56*a* of the second, angled channel 54 (position 70) such that the end 67 of the conduit 66 is uncovered. As shown in FIG. 5 by the arrows 114, liquid from an outside source is drawn in through the liquid inlet tube (not shown), through the liquid inlet bore 19, through the passageway (not shown) into the liquid chamber 65, into the longitudinal conduit 66 in the stem portion 43 of the piston 38, into the angled channel 54, past the sealing member 55 into the slot 57, and out the head 42 to the pump chamber 69.

As seen in FIGS. 4 and 6, when compressed air is injected through the inlet chamber (through an air inlet tube (not shown) coupled to the air inlet bore 18), pressure against the disc-shaped end 46 of the piston 38 increases. When the air pressure in the inlet chamber 31 exceeds the counterforce of the spring 40, the slidable piston 38 is pushed in the direction of arrow 112 toward the evacuation valve 99.

The force of the piston 30 against the liquid in the pump chamber 69 causes an increase in the fluid pressure against the evacuation valve 99, causing the valve to disengage the contact points 80 and 81 and allowing liquid to flow into the evacuation chamber 73. The piston 38 moves (to the left) in the direction of arrow 112, contacts the evacuation valve 99 and pushes the evacuation valve 99 a predetermined distance "D" away from the contact points 80 and 81. This distance (D) is about 0.003–0.013 inch, and is referred to as the "kick-off" amount. This action ejects all of the measured volume of liquid and any air that has been trapped in the pump chamber, out of the pump chamber 69 into the liquid evacuation chamber 73.

As shown by the dashed arrows 116, the liquid flows around the sides of the valve nut 101, around the spring 98, and into the bores 97 and 105 of the sleeve 90 and the outlet fitting 26, respectively. Simultaneously, the sealing member 55 in the piston 38 is caused to move to the second position 71 adjacent to the second side 56*b* of the angled channel 54 wherein the end 67 of the conduit 66 is blocked to stop the flow of liquid into the channel 66 and the liquid chamber 65 to prevent backflow.

The liquid flowing through the central bore 105 of the outlet fitting 26 can be atomized by air fed in from a second air inlet 21 in the main body 11 of the lubricator 10. The flow of air is varied by adjusting the depth of the insertion of the output air flow adjuster 24 in the bore 25. The atomized liquid travels in the direction of arrow 120 out of the outlet fitting 26 into the connected tubing (not shown) that can then be connected to a device such as an air tool (also not shown).

At the end of the cycle, air flow from the compressed air sources stops, the piston 38 slides in the direction of arrow 110 back to its original position, as shown in FIG. 3, and the pump chamber 69 is closed with the plug seal 103 of the evacuation valve 99 by the force applied by the spring 98 in the direction of arrow 110 (FIG. 5). When air flows again, the piston cycle is repeated.

Referring to FIGS. 2 and 3, the amount of liquid that is fed into the pump chamber 69 with each working stroke of the piston 38 is adjusted by means of the liquid adjustment stem 12. As noted, the liquid adjustment stem 12 is disposed in the inlet chamber 31. The stem 12 includes a graduated ring to provide a scale for individuals operating the lubricator 10. The graduation permits the operator to gauge or measure the amount he or she has adjusted the stroke of the piston 38. By turning the stem 12 into the body 11, the stroke of the piston 38 is shortened. By turning the stem 12 out of the body 11, the stroke of the piston 38 is increased. Thus, the stem 12 provides a means for adjusting the stroke of the piston 38.

The amount of air flowing to the air inlet bore 18, through the gap 32, and to the piston 38 can be varied by standard controls on the source of compressed air (not shown). Preferably, the source of compressed air will deliver pulses of compressed air at an air pressure of about 30–180 psi that can be adjusted as desired from 0–1200 air pulses per minute.

Calibration

The present invention is designed to facilitate its calibration to a zero reference so that precise metering of lubricant can be carried out. The lubricator should be calibrated to account for the variable kick-off amount which varies with each lubricator according to manufacturing tolerances. Preferably, the kickoff amount ranges from about 0.003–0.013 inch depending upon the manufacturing tolerances. The stroke length of the piston 38 should also be calibrated so that the desired volume of fluid is delivered when the pump is actuated.

In calibrating the lubricator, the actual kick-off (and thus the manufacturing tolerances) is measured to verify that the kick-off is between about 0.003–0.013. Having a kick-off of this amount ensures that the liquid and air bubbles are pumped out of the pump chamber 69 and into the liquid evacuation chamber 73.

Figures 7, 8:
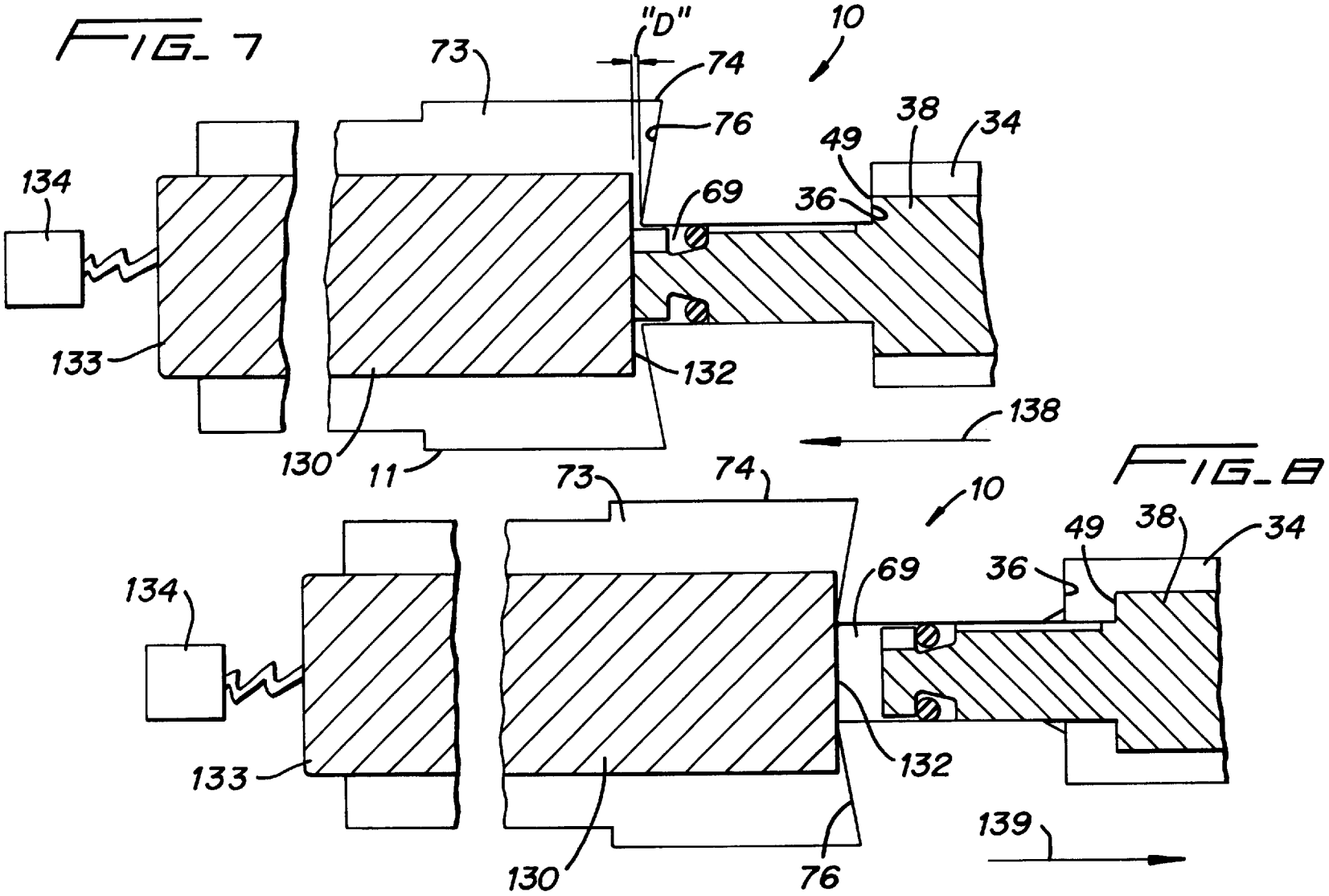
FIG. 7 is an enlarged cross-sectional view of a portion of the piston as illustrated in FIG. 6, with the evacuation chamber having the valve assembly removed and containing a probe for calibrating the kick-off value, and with the piston in a locked, first position.
FIG. 8 is a cross-sectional view of the lubricator of FIG. 7 with the piston in an unlocked, second position, and the kick-off calibration probe seated against the curved wall of the evacuation chamber.

As shown in FIG. 7, a probe 130 that is operable to measure linear motion is used to measure the kick-off amount ("D") of the piston 38 in the lubricator 10. The kick-off calibration probe 130 is sized to fit into the evacuation chamber 73, with a first end 132, and a second end 133 which is connected to a digital (or dial) indicator 134.

To measure the kick-off amount (D), the evacuation valve assembly 90 and spring 98 are removed from the evacuation chamber 73. The body 11 of the lubricator 10 is mounted in a stationary position, for example, in a vice or clamp (not shown). The kick-off calibration probe 130 is inserted into the empty chamber 73 until the end 132 rests against the curved wall 76 at the first end 74 of the evacuation chamber 73. As shown in FIG. 7, the piston 38 is pushed forward in the direction of the arrow 138 by turning the adjustment stem 12 (not shown) until the shoulder 49 of the piston 38 contacts the stop 36 of the piston chamber 34. The piston 38 is locked in position at the point of contact with the stop 36, and the digital indicator 134 is set to a zero calibration.

The piston 38 is then unlocked and, as shown in FIG. 8, the piston 38 and probe 130 move in the direction of arrow 139 until the piston 38 is at the top position and the end 132 of the probe 130 rests against the curved wall 76 of the evacuation chamber 73. The resulting reading from the digital indicator is the "kick-off" amount (D), or distance that the piston 38 will move the evacuation valve assembly 90 to meter the liquid into the evacuation chamber 73 (FIG. 7). The graduated calibration ring 14 is then set at zero (e.g., zero stroke). This setting ensures that the piston 38 will extend into the evacuation chamber 73 and achieve the kick-off amount (D) each time the piston is actuated.

Figure 9:
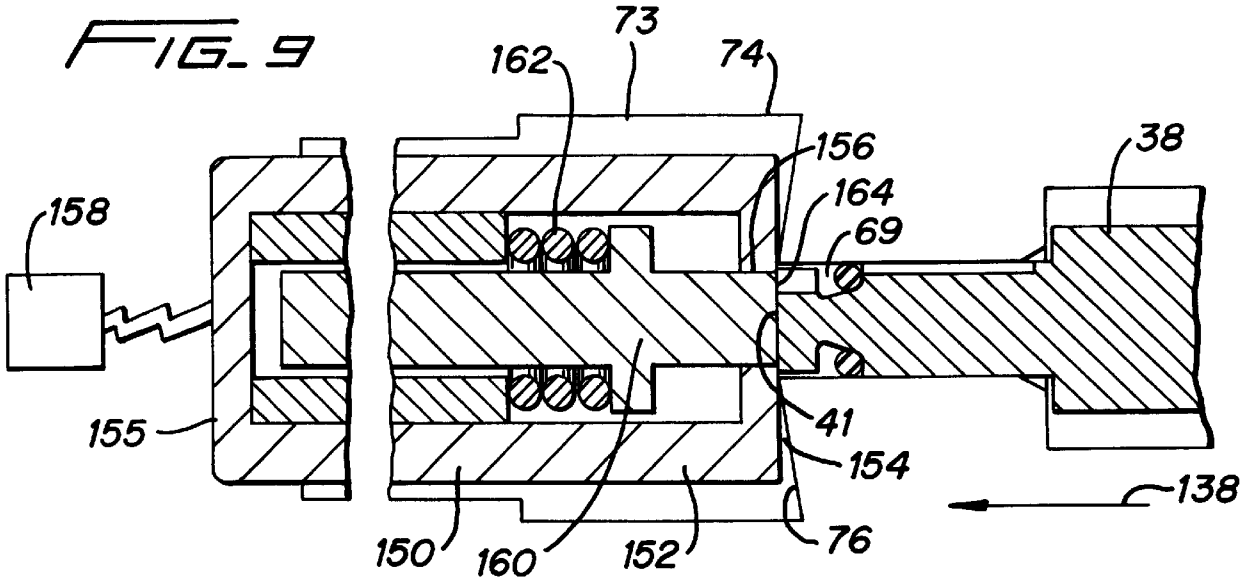
FIG. 9 is an enlarged cross-sectional view of a portion of the piston as illustrated in FIG. 6 with a probe for calibrating the stroke-length of the piston inserted in the evacuation chamber (with the evaculation valve assembly removed), and the piston in a locked, first position.

The total stroke length of the piston 38 in the apparatus 10 is equivalent to the kick-off amount (D) plus the set distance of the desired stroke of the piston. This ensures that the desired volume of liquid will be effectively pumped from the pump chamber 69 into the evacuation chamber 73. To set the desired stroke length of the piston 38, a stroke length calibrating probe 150 is inserted into the empty evacuation chamber 73, as shown in FIG. 9. The stroke length calibrating probe 150 has a hollow cylindrical body 152, a first end 154 with an opening 156 therein, and a second end 155 that it is connected to an indicator 158 (dial or digital). Mounted inside the cylindrical body 152 is a moveable, rod-shaped plunger 160 and a biasing spring 162. The plunger 160 has an end 164 that is sized to extend through the opening 156 in the first end 154 of the probe 150.

The stroke length calibrating probe 150 is inserted into the evacuation chamber 73 and locked in place with the first end 154 of the probe 150 in contact with the curved wall 76 of the first end 74 of the chamber 73. The piston 38 is pushed toward the probe 150 in the direction of arrow 138 by turning the adjustment stem 12 (not shown) until the end 41 of the piston 38 contacts the end 164 of the plunger 160, which is the zero set point for the volume of liquid to be dispensed. At this point, the dial indicator 158 is set at zero. If, however, it is desired to have a predetermined calibrated length (e.g., a shut-off point), the piston 38 can be backed up from the end 164 of the plunger 160 for an appropriate distance.

Figure 10:
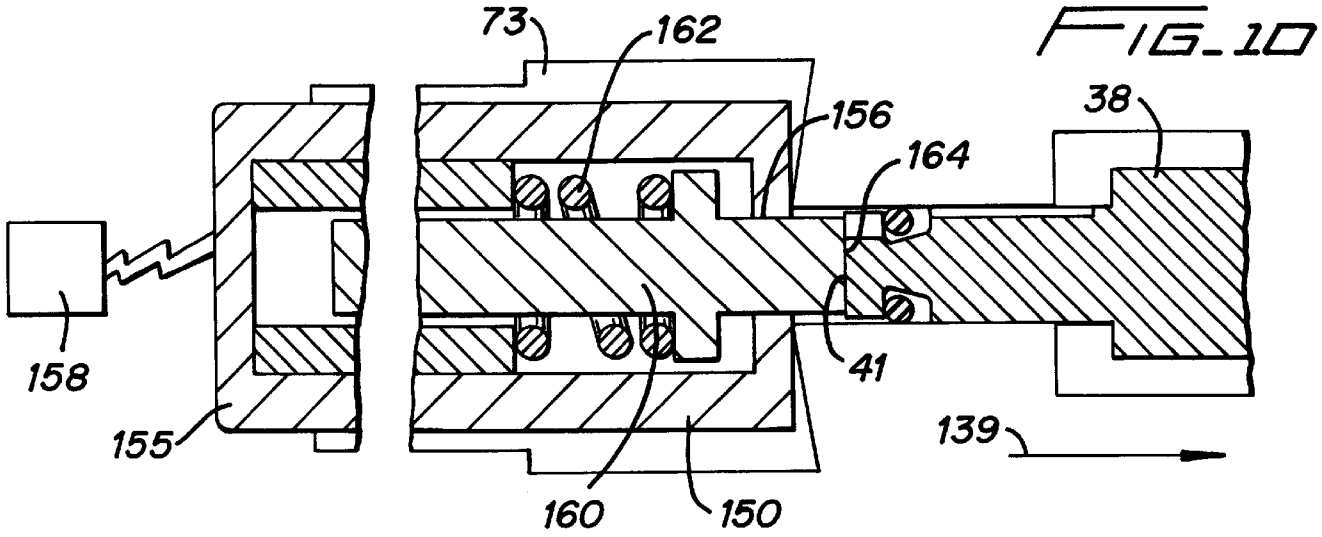
FIG. 10 is a cross-sectional view of the lubricator of FIG. 9 with the piston in an unlocked, second position, and the probe of the stroke-length calibration fixture extended and in contact with the end of the piston.

Referring to FIG. 10, the adjustment stem 12 is then opened. This allows the piston 38 and the plunger 160 by the action of the biasing spring 162 to move in the direction of the arrow 139 until the dial indicator reading is at the desired stroke length, e.g., the volume of fluid to be delivered each time the pump is actuated. This setting ensures that the piston 38 will provide an effective pumping action to deliver the desired volume of liquid from the pump chamber 69 into the evacuation chamber 73. The adjustment stem 12 can adjust the stroke of the piston 38 and thus the amount of liquid that is metered by it. The probe 150 is then removed, and the device may then be tested to verify the stroke length or be put into operation.

For most applications, the lubricator will be calibrated to have a zero stroke. However, an additional amount may be added to the set distance so as to adjust the lubricator to have a predetermined minimum stroke, thus making it impossible to completely shut off lubricant flow. After the zero stroke or a predetermined minimum stroke has been established, the calibration ring 14 can be appropriately marked to indicate the amount of stroke of the piston 38, e.g., a zero stroke or minimum stroke, or a maximum stroke according to the position of the adjustment stem 12.

The ability to calibrate the slidable piston 38 as provided herein, permits a lubricator of the present invention to deliver lubricant or other liquid in individual metered amounts from about 0.0004–0.2 ml.

The invention has been described by reference to detailed examples and methodologies. These examples are not meant to limit the scope of the invention. Variation within the concepts of the invention are apparent to those skilled in the art. The disclosures of the cited references are incorporated by reference herein.

What is claimed is:

1. A piston for use in a pneumatically-activated pump having a chamber, the piston comprising:

a first grooved end section having a head, a channel circumferentially disposed about the piston, and a slot extending from the head to the channel; the channel having a first side, a second side, and a base portion therebetween, and sized to receive a movable sealing member therein;

a stem section having a longitudinally disposed conduit on the periphery thereof, the conduit having a first end and a second end, the first end of the conduit being in a fluid-flowing relation with the channel; and a second end section;

wherein when the sealing member is seated in and adjacent to the first side of the channel, the first end of the conduit is open to allow unrestricted fluid flow between the conduit and the channel, and when the sealing member is adjacent to the second side of the channel, the first end of the conduit is blocked by the sealing member to prevent fluid flow between the conduit and the channel.

2. A piston according to claim 1, wherein the channel base portion is oriented at an angle from the first side to the second side, with the channel having a depth that is greater adjacent the first side.

3. A piston according to claim 1, further comprising a sealing member movably seated in the channel.

4. A piston according to claim 1, wherein the piston is stepped and has an intermediate section; the second end section having a diameter greater than the diameter of the intermediate section.

5. A pneumatically-activated pump, comprising:

a) a body having a central chamber and a chamber for holding a liquid source; and b) a piston disposed in the chamber, the piston comprising:

a grooved end section with a head; a circumferentially disposed channel with a first side, a second side, a base portion therebetween, and a sealing member movably seated therein; and a slot in the head providing a fluid flowing connection between the channel and the head; and a stem section having a longitudinally disposed conduit on the periphery thereof, the conduit having a first end in fluid-flowing relation with the channel; and a second end;

wherein the liquid chamber surrounds the stem, and lateral motion of the piston within the chamber of the pump causes the sealing member to move between a first position where the sealing member is adjacent the first side of the channel with the first end of the conduit open to allow unrestricted fluid flow along the periphery of the stem section through the conduit and into the channel, and a second position where the sealing member is adjacent the second side of the channel with the first end of the conduit closed to prevent fluid flow between the conduit and the channel.

6. A pump according to claim 5, wherein the channel base portion is oriented at an angle from the first side to the second side, with the channel having a depth that is greater adjacent the first side.

7. A pump according to claim 5, further comprising an assembly for adjusting the amount of liquid metered by the pump.

8. A piston for use in a pneumatically-activated pump having a chamber; the piston comprising a first end and a second end, with means for receiving and conducting a fluid along a length of the piston and out of the first end; and means for alternately opening and closing said fluid receiving/conducting means to prevent fluid flow therethrough;

wherein the fluid receiving/conducting means includes a first slot extending longitudinally on the periphery of the piston, being in fluid communication with a second slot in the first end of the piston, the fluid receiving/conducting means providing unrestricted fluid flow along the length and out the first end of the piston.

9. The piston according to claim 8, wherein the opening/closing means is a channel circumferentially disposed about the piston between and in fluid communication with the conduit and the slot; the channel having a first side, a second side, a base portion thereinbetween, and a moveable sealing member seated in the channel;

wherein, when the sealing member is seated in and adjacent to the first side of the channel, the first end of the conduit is open to allow fluid communication between the conduit and the channel, and when the sealing member is adjacent to the second side of the channel, the first end of the conduit is closed by the sealing member to prevent fluid communication between the conduit and the channel.

10. A method of metering an amount of liquid using a pneumatically-activated pump according to claim 5, comprising:

delivering a liquid to a liquid chamber in the body of the pump;

transferring the liquid to the pump chamber in the body of the pump by passing the liquid through the conduit, the channel, and the slot in the piston disposed at least partially in the pump chamber; and moving the piston within the body of the pump to cause a metered amount of the liquid to be expelled from the pump chamber.

11. A piston for use in a pneumatically-activated pump having a chamber, the piston comprising:

a first grooved end section having a head, a channel circumferentially disposed about the piston, and a slot extending from the head to the channel; the channel having a first side, a second side, and a base portion therebetween, a first diameter adjacent to the first side, and a second diameter adjacent to the second side;

a sealing member having an inner diameter and positioned in the channel;

a stem section having a longitudinally disposed conduit on the periphery thereof, the conduit having a first end and a second end, the first end of the conduit being in an unrestricted fluid-flowing relation with the channel; and a second end section;

wherein the first diameter of the channel is about 60–80% of the inner diameter of the sealing member and the second diameter of the channel is about 105–125% of the inner diameter of the sealing member; and when the sealing member is adjacent to the first side of the channel, the first end of the conduit is open to allow unrestricted fluid communication between the conduit and the channel, and when the sealing member is adjacent to the second side of the channel, the first end of the conduit is blocked by the sealing member to prevent fluid communication between the conduit and the channel.

12. The piston according to claim 11, wherein the piston is stepped and has an intermediate section; the second end section having a diameter greater than the diameter of the intermediate section.

13. The piston according to claim 11, wherein the first diameter is about 70% of the inner diameter of the sealing member, and the second diameter is about 115% of the inner diameter of the sealing member.

14. A method of calibrating a device for metering a liquid, the device including an adjustment stem and a piston aligned with the adjustment stem, the piston having a pumping motion, movable to a position where the adjustment stem and the piston are in contact with one another, and axially moveable in a pump chamber to meter liquid into and dispense liquid out of the pump chamber, the axial movement of the piston including a stroke length from a first position to a second position to meter liquid into the pump chamber, and a set distance from the second position to a third position to dispense the liquid from the pump chamber into an evacuation chamber, the set distance being the stroke length and a kick-off amount from the first position to the third position;

the piston having a grooved end section with a head, a circumferentially disposed channel with a first side, a second side, a base portion therebetween, and a sealing member movably seated therein, and a slot providing a fluid flowing connection between the channel and the head; a stem section having a longitudinally disposed conduit, the conduit having a first end in fluid-flowing relation with the channel; and a second end; wherein lateral motion of the piston within the chamber of the pump causes the sealing member to move between a first position where the sealing member is adjacent the first side of the channel with the first end of the conduit open to allow fluid communication between the conduit and the channel, and a second position where the sealing member is adjacent the second side of the channel with the first end of the conduit closed to prevent fluid communication between the conduit and the channel;

the method comprising the steps of:

measuring the kick-off amount of the piston;

determining the stroke length of the piston;

setting the piston to a position of the set distance; and mounting a stopping mechanism on the adjustment stem so as to maintain the axial movement of the piston to the set distance.

15. The piston according to claim 1, wherein the conduit is a slot extending longitudinally on the periphery of the stem section.

* * * * *